United States Patent [19]

Takashiba et al.

[11] Patent Number: 4,746,103

[45] Date of Patent: May 24, 1988

[54] LANCE FOR BLOW-REFINEMENT IN CONVERTER

[75] Inventors: Nobuyoshi Takashiba; Shinji Kojima; Rinzo Tachibana; Takayasu Yamada; Fumiaki Yoshikawa, all of Kurashiki, Japan

[73] Assignee: Kawasaki Steel Corporation, Hyogo, Japan

[21] Appl. No.: 897,524

[22] Filed: Aug. 18, 1986

[30] Foreign Application Priority Data

Aug. 20, 1985 [JP] Japan ..... 60-182487
Jan. 10, 1986 [JP] Japan ..... 61-3240

[51] Int. Cl.[4] ..... C21C 5/32
[52] U.S. Cl. ..... 266/266; 266/225
[58] Field of Search ..... 266/225, 266, 270

[56] References Cited

U.S. PATENT DOCUMENTS 3,745,943 7/1973 Nothstein ..... 266/270

FOREIGN PATENT DOCUMENTS 1064970 9/1959 Fed. Rep. of Germany .
3231867 3/1984 Fed. Rep. of Germany ..... 266/225
1346214 11/1963 France .
1543169 9/1968 France .
53-10225 6/1978 Japan .
1190137 4/1970 United Kingdom .
438702 1/1975 U.S.S.R. ..... 266/225

*Primary Examiner*—L. Dewayne Rutledge
*Assistant Examiner*—Robert L. McDowell
*Attorney, Agent, or Firm*—Austin R. Miller

[57] ABSTRACT

A lance for blow-refinement in a converter comprises a primary nozzle generating a high-velocity, high-pressure primary oxygen jet, and an auxiliary nozzle generating an auxiliary oxygen jet. The auxiliary oxygen jet formed by the auxiliary nozzle has a velocity lower than the speed of sound. The auxiliary nozzle is configured so as to impede but not prevent oxygen flow therethrough. In the preferred construction, deceleration of gas-metal reaction induced by the oxygen jet.

15 Claims, 4 Drawing Sheets

LANCE FOR BLOW-REFINEMENT IN CONVERTER

BACKGROUND ON THE INVENTION

The present invention relates generally to a lance for blow-refinement in a converter such as a Bessemer converter. More specifically, the invention relates to a lance having an auxiliary nozzle which can improve the thermal efficiency of secondary combustion in a converter.

As is well known, a lance for blow-refinement installed in the converter is directed to a molten metal bath for injecting a high-pressure, high-velocity jet of oxygen to cause strong churning and rapid reaction near the molten metal bath surface. High-purity, high-energy gaseous oxygen injected toward the molten metal bath surface causes a gas-metal reaction, specifically carbon reduction. At the same time, the oxygen flow causes a slag-metal reaction, such as slagging of lime, and scavenging of phosphorus. When the proportion of pig iron in the source material is relatively high, specifically approximately 95%, the carbon content in the pig iron is sufficient as a heat source to heat the molten metal. At lower proportions of pig iron and high proportions of scrap and/or iron ore, it becomes necessary to heat the molten metal externally to compensate for the lack of an internal heat source. There are two ways to do this: one is to supply a carboniferous material, such as coke; the other way is to induce combustion of the carbon monoxide (CO) generated by the carbon-reducing gas-metal reaction, by supplying oxygen ($O_2$) through an auxiliary nozzle.

Various lances have been proposed and which include an auxiliary nozzle for supplying the oxygen needed for secondary combustion of carbon monoxide. A typical structure of this kind of lance has been disclosed in Japanese Patent First Publication (Tokkai) No. shows 53-102205. The lance disclosed has a plurality of primary nozzles and a plurality of auxiliary nozzles arranged alternatingly. The injecting outlets of the auxiliary nozzles are located higher, i.e. further from the bath surface than the primary nozzles. These primary and auxiliary nozzles adjoin and oxygen passage through the lance. The lance is also provided with a cooling medium circuit for a cooling medium, such as cooling water.

In this known arrangement, the refining operation in the converter is mediated by secondary combustion of carbon monoxide generated in the primary gas-metal reaction. The internal pressure in the converter is held at about atmospheric pressure. On the other hand, the internal pressure in the oxygen passage of the lance is several $kg/cm^2$ to several tens of $kg/cm^2$. The primary nozzles are in the form of Laval nozzles. The velocity of the oxygen discharged through the primary nozzle is supersonic. The high discharge velocity of the oxygen ensures that the pressure of the oxygen stream at the molten metal surface will be higher than the static pressure of the slag on the molten metal surface, even though the oxygen is injected from a distance from the molten metal surface of about 1 to 3 m. Specifically, this oxygen jet flows at velocity of over 100 m/sec. Therefore, the oxygen jet churns up the molten metal bath and induces rapid reaction.

On the other hand, the auxiliary nozzles are located higher than the primary nozzles and are essentially straight and untapered. The auxiliary nozzles discharge oxygen at near the speed of sound. Because of their greater distance from the molten metal bath and their straight shape, the auxiliary nozzles produce lower-energy oxygen jets. Thus the oxygen discharged through the auxiliary nozzles can more easily react with the carbon monoxide gas generated by the gas-metal reaction induced by the oxygen jet.

The maximum secondary combustion rate of this conventional blow-refinement lance is about 30% and its heating efficiency is limited to about 20%. However, the effective heating efficiency is significantly lower than 20%. Although this heating efficiency can be improved by adjusting the ratio of pig iron to scrap, the maximum possible increase in heating efficiency is only about 5%.

On the other hand, on the market, the price of scrap is dropping due to continuing increases in supply. Therefore, from the viewpoint of cost, the need for increasing the proportion of scrap is urgent. This requires an improvement in lance design to achieve a higher secondary combustion rate and higher heating efficiency for the molten metal.

SUMMARY OF THE INVENTION

Therefore, it is an object of the present invention to provide a blow-refinement lance for a converter which can achieve a higher secondary combustion rate and a higher heating efficiency.

Another and more specific object of the present invention is to provide an improved lance which can slow down the oxygen jet discharged through the auxiliary nozzle in order to achieve a higher secondary combustion rate and a higher heating efficiency.

In order to accomplish the aforementioned and other objects, a lance for blow-refinement in a converter comprises a primary nozzle generating a high-velocity, high-pressure primary oxygen jet, and an auxiliary nozzle generating an auxiliary oxygen jet. The auxiliary oxygen jet formed by the auxiliary nozzle has a velocity lower than the speed of sound. The auxiliary nozzle is configured so as to impede but not prevent oxygen flow therethrough.

In the preferred construction, deceleration of the oxygen jet from the auxiliary nozzle is achieved by exerting resistance to oxygen flow.

According to one aspect of the invention a lance for blow-refinement in a converter comprises a pressurized oxygen source, a primary nozzle having an outlet directed toward the surface of a molten metal bath in the converter and forming a high-pressure high-velocity primary oxygen jet capable of agitating the molten metal and inducing a chemical reaction therewith, an auxiliary nozzle for forming an auxiliary oxygen jet for inducing secondary combustion of carbon monoxide generated in the reaction induced by the primary oxygen jet, and means, incorporated in the auxiliary nozzle, for limiting the velocity of oxygen flow through the auxiliary nozzle to a point where the resulting jet forms a combustion zone in which the carbon monoxide oxidizes above the molten metal surface and for adjusting the velocity of the auxiliary oxygen jet within the combusting zone to approximately the flame propagation speed therein.

The flow velocity limiting means controls the velocity of the auxiliary oxygen jet at the outlet of the auxiliary nozzle to below the speed of sound, preferably, no greater than 100 m/sec.

The diameter at the outlet of the auxiliary nozzle is greater than that at an inlet opening into the pressurized oxygen source.

The flow velocity limiting means comprises means for defining a taper in the auxiliary nozzle by which the diameter of the auxiliary nozzle gradually increases toward the outlet. In the alternative embodiment, the flow velocity limiting means comprises a member exerting resistance to oxygen flow through the auxiliary nozzle. The auxiliary nozzle has a first section adjoining the pressurized oxygen source in which the inner diameter increases toward the outlet, a second section adjoining the larger-diameter end of the first section and having a constant diameter, and a third section adjoining the end of the second section remote from the first section, including the outlet and having inner diameter gradually increasing toward the outlet. Preferably, the flow resistance member is disposed within the second section.

In the preferred construction, the flow resistance member is a multi-conduit assembly defining a plurality of small-diameter conduits exerting resistance to oxygen flow through the second section. Alternatively the flow resistance member defines a zig-zag path for oxygen flow through the second section.

The first section has an inlet at the point of juncture with the pressurized oxygen source and the ratio of the diameters of its distal end and the inlet is in the range of 1.1 to 10.0 and the diameter of the outlet is 1.1 to 20.0 times the diameter of the inlet 10, wherein the axial length of the auxiliary nozzle is between 1 and 200 times the diameter of the inlet.

If necessary, the pressurized oxygen source comprises a primary oxygen source connected to the primary nozzle and an auxiliary oxygen source connected to the auxiliary nozzle, the primary and auxiliary sources supplying pressurized oxygen to the primary and auxiliary nozzles independently.

BRIEF DESCRIPTION OF THE DRAWINGS

The present invention will be understood more fully from the detailed description given herebelow and from the accompanying drawings of the preferred embodiment of the present invention, which, however, should not be taken to limit the invention to the specific embodiments but are for explanation and understanding only.

In the drawings.

DESCRIPTION OF THE PREFERRED EMBODIMENT

Figure 1:
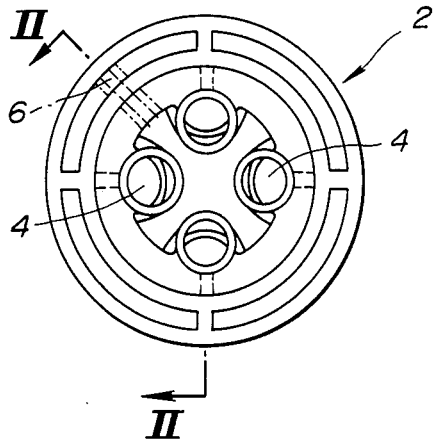
FIG. 1 is a bottom view of the first embodiment of a lance for blow-refinement according to the invention.
Figure 2:
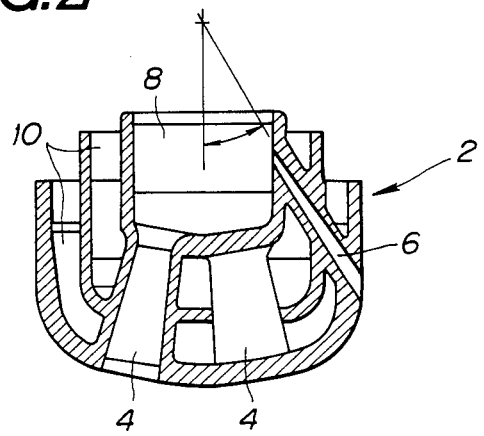
FIG. 2 is a sectional view taken along line II—II of FIG. 1.
Figure 3:
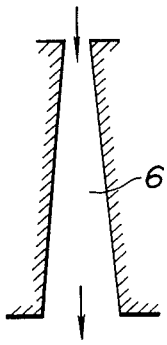
FIG. 3 is an enlarged section through an auxiliary nozzle in the first embodiment of the lance of FIG. 2.

Referring now to the drawings, particularly to FIGS. 1 to 3, the first embodiment of a lance 2 for blow-refinement in a converter, according to the present invention, has a plurality of primary nozzles 4 and a plurality of auxiliary nozzles 6. In practice, there will be 3 to 5 of the primary and auxiliary nozzles 4 and 6. The primary and auxiliary nozzles 4 and 6 are arranged alternating at given intervals radially around the lance 2. Each of the primary and auxiliary nozzles 4 and 6 has an outer or upper end adjoining an oxygen passage 8 through the axis of the lance 2. Essentially annular cooling medium passages 10 surround the oxygen passage 8 and the primary and the auxiliary nozzles 4 and 6.

The oxygen passage 8 is connected to an oxygen source (not shown) in a per se well-known manner. Therefore, high-purity and high-pressure of oxygen ($O_2$) is supplied through the oxygen passage 8. In practice, the pressure of the oxygen within the oxygen passage 8 is several kg/cm$^2$ to several tens of kg/cm$^2$. On the other hand, the cooling medium passages 10 are connected to a cooling medium source (not shown) to conduct a cooling medium, such as coolant, cooling water or the like.

Each primary nozzle 4 is in the form of a Laval nozzle and has an inner or lower end located near the central axis of the lance and directed toward the upper surface of a molten metal bath in the converter. The primary nozzles 4 thus direct oxygen jets toward the upper surface of the molten metal bath, which oxygen jets discharged through the primary nozzles will be hereafter referred to as "primary oxygen jets" or "primary jets". The configuration of the primary nozzles 4 is determined so that the velocity of the primary oxygen jets discharged or injected therethrough will be supersonic. The high velocity and resulting high kinetic energy of the primary oxygen jets causes strong churning in the molten metal bath and an accordingly rapid reaction. This reaction generates carbon monoxide, which becomes available for secondary combustion.

On the other hand, the inner or lower ends of the auxiliary nozzles 6 open onto the sides of the lance 2 rather than on its lower face. The inner ends of the auxiliary nozzles 6 are thus located further from the molten bath than the inner ends of the primary nozzles 4. The auxiliary nozzles 6 are so arranged and configured to discharge oxygen at a velocity lower than the speed of sound, preferable lower than 100 m/sec. The oxygen jets formed by the auxiliary nozzles 6 will be hereafter referred to as "auxiliary oxygen jets" or "auxiliary jets". When the inner ends of the auxiliary nozzles 6 lie 1.5 to 4.0 m distance from the upper surface of the molten metal bath, the velocity of the auxiliary oxygen jets discharged through the auxiliary nozzles 6 must be adjusted so as to induce flame propagation at distances of 1.0 to 4.0 m from the inner ends of the auxiliary nozzles 6.

According to the first embodiment of the lance 2 according to the present invention, the auxiliary nozzles 6 gradually increase in internal diameter toward their inner ends, as shown in FIG. 3. In this configuration, the velocity of the oxygen jet at the outer end of the auxiliary nozzle 6 is about the speed of sound due to the high pressure, i.e., several $kg/cm^2$ to several tens of $kg/cm^2$ and the high velocity, i.e. about 200 m/sec. to 300 m/sec, in the oxygen passage 8. The gradual expansion of the internal diameter of the auxiliary passage 8 lowers both the pressure of the oxygen in the auxiliary nozzle 6 and the velocity of the discharged oxygen jet. By adjusting the rate of the expansion of the internal diameter between the outer and inner ends, the velocity of the auxiliary oxygen jet can be adjusted to below the speed of sound.

A similar deceleration of the auxiliary oxygen jet can be obtained by various configurations of the auxiliary nozzles 6.

Figure 4:
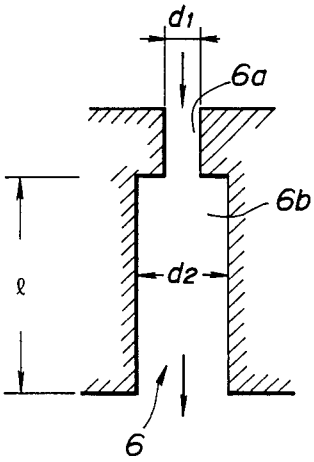
FIG. 4 is a sectional view through the second embodiment of an auxiliary nozzle employed in the preferred embodiment of the lance according to the invention.
Figure 7A:
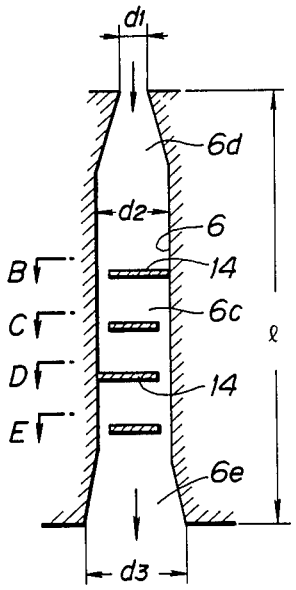
FIGS. 7(A) to 7(E) are sections through the auxiliary nozzle employed in the fourth embodiment of the lance according to the invention.

For instance, in the second embodiment of the auxiliary nozzle 6 of FIG. 4, the auxiliary nozzle has sections 6*a* and 6*b* of differing diameter. The smaller-diameter section 6*a* adjoins the outer end and has a diameter $d_1$. On the other hand, the larger-diameter section 6*b* is located downstream of the smaller-diameter section 6*a* and adjoins the inner end. The diameter $d_2$ of the larger-diameter section 6*b* is significantly greater than that of the smaller-diameter section. In the preferred embodiment, the ratio of the diameters $d_1$ and $d_2$ is in the range of $d_2/d_1=1.1$ to 7.0. Furthermore, the length C of the larger diameter section 6*b* should fall in the range $d_2<C<200d_2$ based on empirical observations.

Figure 5:
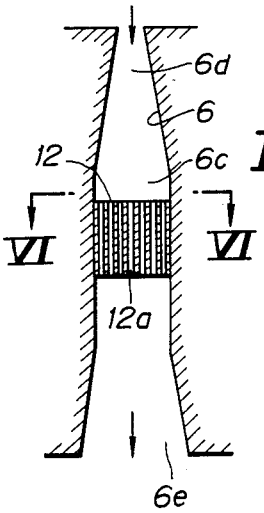
FIG. 5 is a sectional view through the auxiliary nozzle to be employed in the third embodiment of the lance according to the invention.
Figure 6:
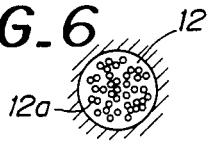
FIG. 6 is a section taken along line VI—VI of FIG. 5.
Figure 7B:
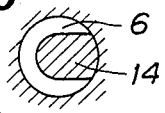
Figure 7C:
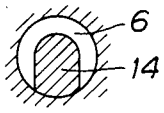
Figure 7D:
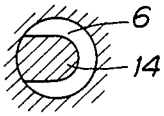
Figure 7E:
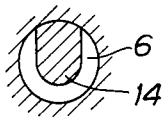

On the other hand, in the third embodiment of FIG. 5, the auxiliary nozzle 6 increases in internal diameter gradually toward the inner end. The auxiliary nozzle 6 of FIG. 5 also has a fixed- diameter section 6*c* separating tapering upper and lower sections 6*d* and 6*e*. A flow-restriction conduit assembly 12 is disposed within the fixed-diameter section 6*c*. The conduit assembly 12 comprises a plurality of a small-diameter or capillary conduits 12*a*, as shown in FIG. 6. These small-diameter conduits 12*a* exert resistance against the oxygen flow through the auxiliary nozzle 6 and so lowers the velocity of the oxygen to below the speed of sound. This conduit assembly 12 thus augments the effect of the taper of the auxiliary nozzle 6 which gradually increases in diameter toward the inner end in the sections 6*d* and 6*e*. This achieves a more pronounced deceleration than in the first and second embodiments of FIGS. 3 and 4.

A similar effect can be achieved by the fourth embodiment of the auxiliary nozzle 6 of FIGS. 7(A) to 7(E). In this fourth embodiment, a plurality of flow-restricting vanes 14 extend inward from the inner periphery of the fixed-diameter section 6c of the auxiliary nozzle 6. The flow-restricting vanes 14 lie perpendicular to the longitudinal axis of the auxiliary nozzle. Each vane 14 occludes the center of the auxiliary nozzle 6, leaving a peripheral section open for oxygen flow. The vanes 14 are arranged so that they overlap as viewed along the axis of the auxiliary nozzle 6. Therefore, a zig-zag path is defined through the fixed- diameter section 6*c* of the auxiliary passage 6. This further slows down the oxygen flow.

Figure 8:
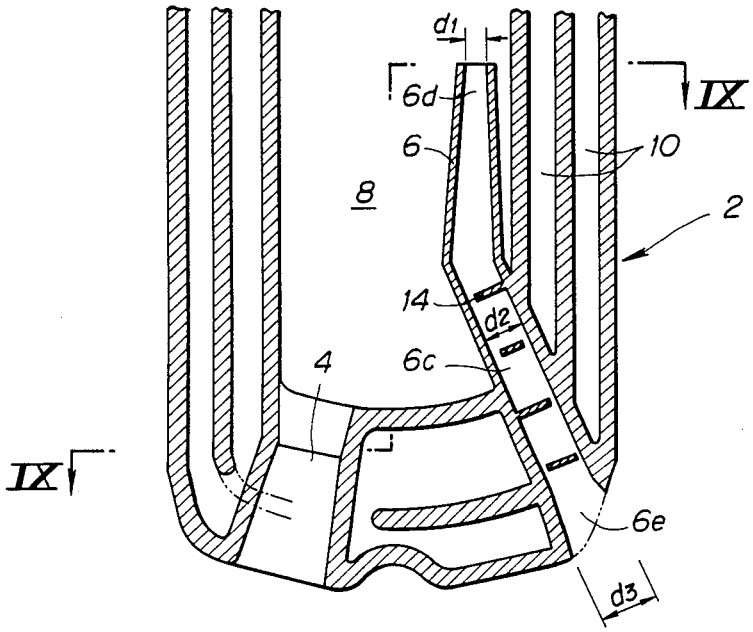
FIG. 8 is a sectional view through a practical example of the fourth embodiment of FIG. 6.
Figure 9:
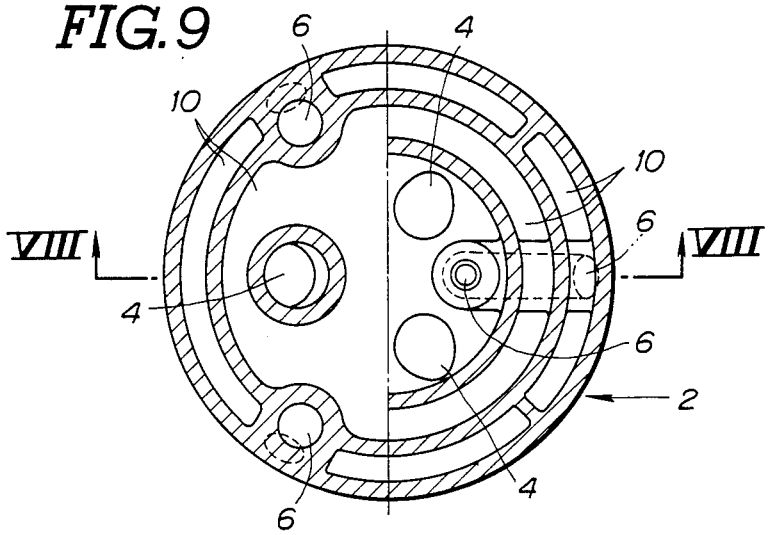
FIG. 9 is a view taken along the sections taken along the lines IX—IX in FIG. 8.

FIGS. 8 and 9 show a practical application of the auxiliary nozzle 6 of the fourth embodiment of FIGS. 7(A) to 7(E). As shown in FIG. 9, three auxiliary nozzles 6 are arranged in the lance 2 at regular angular intervals, i.e. 120°. Similarly, three primary nozzles 4 are arranged radially symmetrically between pairs of auxiliary nozzles 6.

The auxiliary nozzles 6 turn at the point where the outer (upper) section 6*d* and the fixed-diameter section 6*c* meet. The axis of the section 6*d* is essentially parallel to the axis of the lance 2 and the axis of the constant diameter section 6*c* lies oblique to the axis of the lance. The angle of the axis of the fixed-diameter section 6*c* is determined so as to have the inner end of the auxiliary nozzle 6 open at the edge of the lower face of the lance. The inner diameter $d_1$ at the upper end and the diameter $d_2$ of the fixed-diameter section are so proportioned that $d_2/d_1=1.8$. Similarly, the inner diameter $d_3$ at the lower end of the auxiliary nozzle 6 and the diameter $d_2$ of the fixed-diameter section satisfy the expression $d_3/d_2=2.4$. The overall length $\lambda$ of the auxiliary nozzle 6 is selected to be $20d_1$.

Experiments were performed with this auxiliary nozzle 6. The pressure in the oxygen passage 8 was held at 9.5 $kg/cm^2$, which resulted in an auxiliary oxygen jet velocity at the lower end of the auxiliary nozzle 6 of about 70 m/sec.

The velocity of the primary flow at the lower end of the primary nozzle 4 should still be higher than the speed of sound in order to maintain the effect of churning and rapid reaction. At the same time, effective secondary combustion can be achieved by the relatively low-speed auxiliary oxygen jet through the auxiliary nozzles 6.

Experiments have shown that the rate of combustion of the carbon monoxide gas is determined by its the flame propagation speed. The flame propagation speed of carbon monoxide is lower than or equal to 10 m/sec, most commonly several m/sec. Therefore, in order to achieve effective combustion, the velocity of the auxiliary oxygen jet must be lower than or equal to 10 m/sec at the point where the oxygen mixes with the carbon monoxide. Other experiments have shown that it is preferable to define a combustion zone in the region above the molten metal bath in the converter, where a large amount of foaming slag exists. Toward this end, when the lower or inner end of the lance 2 is at a point 1.5 m to 4.0 m above the surface of the molten metal bath, the velocity of the auxiliary oxygen jet in the region 1.0 m to 4.0 m from the inner end of the lance will be approximately equal to the flame propagation speed. To obtain this flow velocity, the output velocity of the auxiliary nozzle 6 must be lower than the speed of sound, preferable lower than 100 m/sec.

Therefore, by adjusting the discharge velocity of the auxiliary oxygen jet at the inner end of the auxiliary nozzle 6 to a velocity of 70 m/sec, effective combustion of the carbon monoxide can be obtained.

On the other hand, experiments have also shown found that heat transmission by the molten metal takes place both by conduction and by radiation. Conductive heating is mediated by the foaming slag which is directly exposed to combustion of carbon monoxide and so accumulates the heat of combustion. When the heated foaming slag returns to the subsurface molten metal bath, it heats the molten metal in the bath. On the other hand, radiative heating is performed directly by the molten metal in the bath. Furthermore, carbon monoxide combustion heats the peripheral walls of the converter. This radiated heat is thus transmitted to the molten metal through the peripheral walls of the converter by conduction.

In an example, blow-refinement was performed in a 200 t/ch converter. Oxygen is introduced not only from the top of the converter but also from below. Oxygen flows at 500N $m^3$/min through the primary nozzles 4 and at 170N $m^3$/min through the auxiliary nozzles. The lower face of the lance 2 is set 3.5 m above the surface of the molten metal bath. By adjusting the velocity of the auxiliary oxygen jet through the auxiliary nozzle 6, the combustion rate of carbon monoxide can be brought to 35% to 40%. The combustion zone is formed in the region 1 m to 2 m from the inner end of the lance 2. This combustion zone lies about 1 m to 2 m above the molten metal bath. At this distance, the combustion zone could efficiently heat the molten metal. A heating efficiency of 60% to 70% was obtained in this experiment.

Given a high efficiency of combustion of carbon monoxide and a high heating efficiency, the amount of the scrap could be increased to a proportion of 20% relative to other materials. This ratio is about four times as great as in the conventional art.

Although the foregoing embodiments are directed to auxiliary nozzles connected to a common oxygen passage together with the primary nozzles, it would be possible to connect the auxiliary nozzles to an oxygen passage separate from the oxygen passage for the primary nozzles. Separating the oxygen passages for the primary nozzles and the auxiliary nozzles would facilitate adjustment of the pressure and flow velocity of the oxygen through the auxiliary nozzles.

Figure 10:
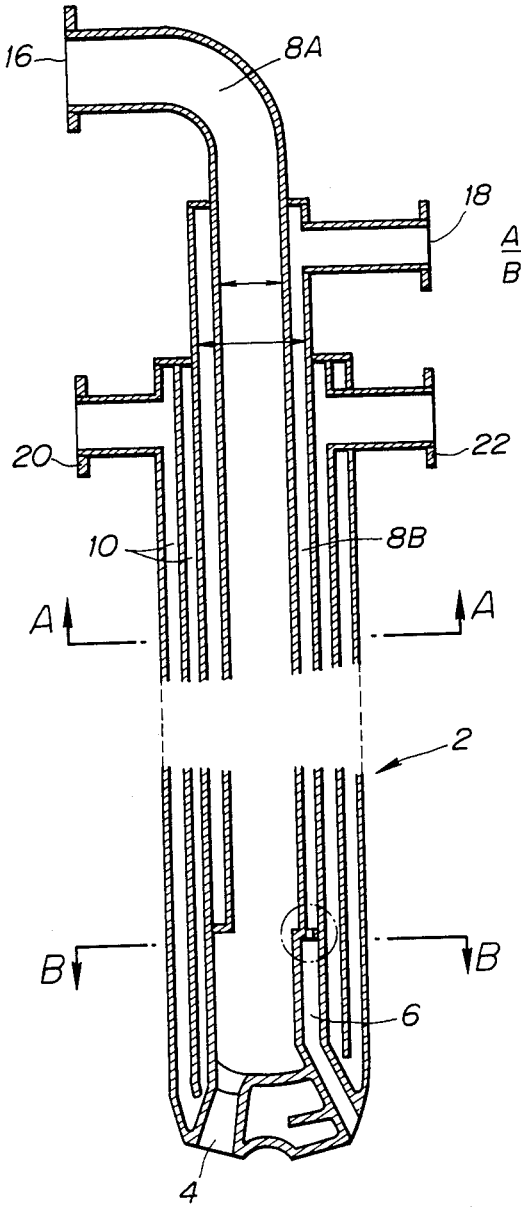
FIG. 10 is a longitudinal section through the fifth embodiment of a lance for blow-refinement according to the present invention.
Figure 11:
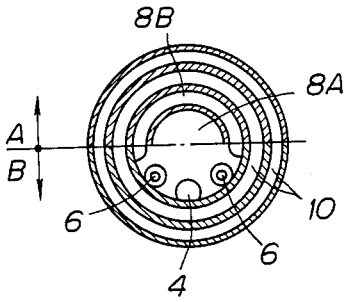
FIG. 11 is a section taken along lines XIA—XIA and XIB—XIB of FIG. 10.
Figure 12:
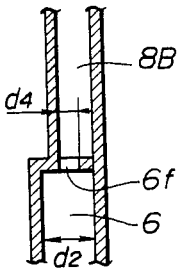
FIG. 12 is an enlarged section of the encircled area XII of FIG. 10.

FIGS. 10, 11 and 12 show the fifth embodiment of the lance according to the invention, in which separate oxygen passages 8A and 8B are defined in the lance. In this embodiment, the primary nozzles 4 are connected to the primary oxygen passage 8A and the auxiliary nozzles 6 are connected to the auxiliary oxygen passage 8B. The auxiliary oxygen passage 8B is annular in cross-section and surrounds the primary oxygen passage 8A. The auxiliary oxygen passage 8B itself is surrounded by the cooling medium passage 10.

The primary oxygen passage 8A is connected to a primary oxygen source (not shown) through an oxygen supply passage which is joined to the outer end 16 thereof. Similarly, the auxiliary oxygen passage 8B is connected to an auxiliary oxygen source (not shown) through an auxiliary oxygen supply passage which is connected to the outer end 18 thereof. Also the cooling medium passage 10 is connected to a cooling medium source (not shown) at the outer end 22 thereof.

The auxiliary nozzles 6 are all connected to the auxiliary oxygen passage 8B through small-diameter orifices **6*f*. The orifice 6*f* has a diameter $d_4$ substantially smaller than the inner diameter $d_2$ of the essentially fixed-diameter auxiliary nozzles 6**.

In practice, the inner diameter $D_1$ of the primary oxygen passage 8A and the inner diameter $D_2$ of the auxiliary oxygen passage **8*b* should exhibit the proportions $D_2/D_1=1.23$. On the other hand, the diameter $d_4$ of the orifice 6*f* and the inner diameter $d_2$ of the auxiliary nozzle 6 should exhibit the proportions $d_2/d_1=1.65$. The overall length $\lambda$ of the auxiliary nozzle should be $20d_2$. With this construction, the flow velocity of the auxiliary oxygen jet at the inner end of the auxiliary nozzle 6** will be about 95 m/sec if oxygen at a pressure of about 10 kg/$cm^2$ is supplied to the auxiliary oxygen passage. Therefore, the auxiliary oxygen jet in the converter will be below the speed of sound and so will generate a flame front near the proper combustion zone.

Therefore, the effects of the former embodiments can be achieved by this embodiment.

In addition to the effects of the former embodiment, further advantages are obtained by this embodiment. For instance, at the beginning and end of refining operation, when the oxygen pressure in the primary and auxiliary oxygen jets is relatively low, the combustion zone tends to rise toward the lance in the former embodiments. This can be prevented by separating the primary oxygen passage and the auxiliary oxygen passage and by adjusting the timing of the auxiliary oxygen flow.

Furthermore, separating the primary and auxiliary oxygen passages allows precise oxygen flow control through the auxiliary nozzles according to combustion conditions in the converter. This further improves the efficiency of carbon monoxide combustion and heating of the molten metal.

While the present invention has been disclosed in terms of the preferred embodiment in order to facilitate better understanding of the invention, it should be appreciated that the invention can be embodied in various ways without departing from the principle of the invention. Therefore, the invention should be understood to include all possible embodiments and modifications to the shown embodiments which can be embodied without departing from the principle of the invention set out in the appended claims.

What is claimed is:

1. A lance for blow-refinement in a converter comprising:

a pressurized oxygen source;

a primary nozzle having an outlet directed toward the surface of a molten metal bath in said converter and capable of forming a high-pressure high-velocity primary oxygen jet for agitating said molten metal and inducing a chemical reaction therewith;

an auxiliary nozzle for forming an auxiliary oxygen jet for inducing secondary combustion of carbon monoxide generated in the reaction induced by said primary oxygen jet, said auxiliary nozzle directing said auxiliary oxygen jet to a point where the resulting jet forms a combustion zone in which said carbon monoxide oxidizes above said molten metal surface; and means, incorporated in said auxiliary nozzle, for limiting the velocity of oxygen flow toward said combustion zone through said auxiliary nozzle and for adjusting the velocity of said auxiliary oxygen jet within said combustion zone to approximately the flame propagation speed therein.

2. A lance as set forth in claim 1, wherein said flow velocity limiting means controls the velocity of said auxiliary oxygen jet at the outlet of said auxiliary nozzle to below the speed of sound.

3. A lance as set forth in claim 2, wherein said flow velocity limiting means controls the velocity of said auxiliary oxygen flow at the outlet of said auxiliary nozzle to a velocity no greater than 100 m/sec.

4. A lance as set forth in claim 3, wherein the diameter at the outlet of said auxiliary nozzle is greater than that at an inlet opening into said pressurized oxygen source.

5. A lance as set forth in claim 4, wherein said flow velocity limiting means comprises means for defining a taper in said auxiliary nozzle by which the diameter of said auxiliary nozzle gradually increases toward the outlet.

6. A lance as set forth in claim 3, wherein said flow velocity limiting means comprises a member exerting resistance to oxygen flow through said auxiliary nozzle.

7. A lance for blow-refinement in a converter comprising;

a pressurized oxygen source;

a primary nozzle having an outlet directed toward the surface of a molten metal bath in said converter and capable of forming a high-pressure high-velocity primary oxygen jet for agitating said molten metal and including a chemical reaction therewith;

an auxiliary nozzle for forming an auxiliary oxygen jet for inducing secondary combustion of carbon monoxide generated in the reaction induced by said primary oxygen jet, said auxiliary nozzle having a first section adjoining said pressurized oxygen source in which the inner diameter increases toward said outlet, a second section adjoining the larger-diameter end of said first section and having a constant diameter, and a third section adjoining the end of said second section remote from said first section, including said outlet and having its inner diameter gradually increasing toward said outlet; and means, incorporated in said auxiliary nozzle, for limiting the velocity of oxygen flow through said auxiliary nozzle to a point where the resulting jet forms a combustion zone in which said carbon monoxide oxidizes above said molten metal surface and for adjusting the velocity of said auxiliary oxygen jet within said combustion zone to approximately the flame propagation speed therein.

8. A lance as set forth in claim 7, wherein a flow resistance member is disposed within said second section.

9. A lance as set forth in claim 7, wherein said flow resistance member is a multi-conduit assembly defining a plurality of small-diameter conduits exerting resistance to oxygen flow through said second section.

10. A lance as set forth in claim 7, wherein said flow resistance member defines a zig-zag path for oxygen flow through said second section.

11. A lance as set forth in claim 7, wherein said first section has an inlet at the point of juncture with said pressurized oxygen source and the ratio of the diameters of its distal end and the inlet is in the range of 1.1 to 10.0 and the diameter of said outlet is 1.1 to 20.0 times the diameter of said inlet.

12. A lance as set forth in claim 10, wherein the axial length of said auxiliary nozzle is between 1 and 200 times the diameter of said inlet.

13. A lance as set forth in claim 1, wherein said pressurized oxygen source comprises a primary oxygen source connected to said primary nozzle and an auxiliary oxygen source connected to said auxiliary nozzle, said primary and auxiliary sources supplying pressurized oxygen to the primary and auxiliary nozzles independently.

14. A lance for blow-refinement in a converter comprising;

a pressurized oxygen source;

a primary nozzle having an outlet directed toward the surface of a molten metal bath in said converter and capable of forming a high-pressure high-velocity primary oxygen jet for agitating said molten metal and inducing a chemical reaction therewith;

an auxiliary nozzle for forming an auxiliary oxygen jet for inducing secondary combustion of carbon monoxide generated in the reaction induced by said primary oxygen jet, said auxiliary nozzle forming said auxiliary oxygen flow toward a point where the resulting jet forms a combustion zone in which said carbon monoxide oxidizes above said molten metal surface; and means, incorporated in said auxiliary nozzle, for limiting the velocity of oxygen flow through said auxiliary nozzle for adjusting the velocity of said auxiliary oxygen jet within said combustion zone in such a manner that said flow velocity of said auxiliary oxygen jet becomes approximately the flame propagation speed as said carbon monoxide combusts in said combustion zone.

15. A lance for blow-refinement in a converter comprising:

a pressurized oxygen source;

a primary nozzle having an outlet directed toward the surface of a molten metal bath in said converter and capable of forming a high-pressue high-velocity primary oxygen jet for agitating said molten metal and inducing a chemical reaction therewith;

an auxiliary nozzle for forming an auxiliary oxygen jet for inducing secondary combustion of carbon monoxide generated in the reaction induced by said primary oxygen jet, said auxiliary nozzle forming said auxiliary oxygen flow toward a point where the resulting jet forms a combustion zone in which said carbon monoxide oxidizes above said molten metal surface; and means, incorporated in said auxiliary nozzle, for limiting the velocity of oxygen flow through said auxiliary nozzle for adjusting the velocity of said auxiliary oxygen jet within said combustion zone in such a manner that said flow velocity of said auxiliary oxygen jet reduces to subsonic speed.

* * * * *